United States Patent [19]

Bolante

[11] Patent Number: 4,738,636

[45] Date of Patent: Apr. 19, 1988

[54] STRAIN RELIEF CONNECTORS FOR FLEXIBLE CORD AND CABLE

[75] Inventor: Jay J. Bolante, Chicago, Ill.

[73] Assignee: Appleton Electric Co., Chicago, Ill.

[21] Appl. No.: 37,787

[22] Filed: Apr. 13, 1987

[51] Int. Cl.[4] ..... H01R 13/59

[52] U.S. Cl. ..... 439/462; 174/65.55; 285/342

[58] Field of Search ..... 439/275, 279, 461, 462; 174/65 R, 65 G, 65 SS; 285/161, 341, 342, 343, 249, 382.7, 331, 332

[56] References Cited

U.S. PATENT DOCUMENTS

| | | | |
|---|---|---|---|
| 2,439,351 | 4/1948 | Thayer et al. | 285/247 |
| 3,240,868 | 3/1966 | Ets-Hokin et al. | 174/93 |
| 3,260,790 | 7/1966 | Alsup | 174/51 |
| 3,365,216 | 1/1968 | Babylon | 285/158 |
| 3,476,412 | 11/1969 | Demler, Sr. | 285/322 |
| 3,603,912 | 9/1971 | Kelly | 174/65 SS |
| 3,647,934 | 3/1972 | Hartt | 174/65 R |
| 3,659,880 | 5/1972 | Goldsobel | 285/161 |
| 3,744,008 | 7/1973 | Castellani | 339/103 B |
| 4,058,330 | 11/1977 | Wolf | 285/174 |
| 4,116,472 | 9/1978 | Schmitt | 285/4 |
| 4,136,897 | 1/1979 | Haluch | 285/342 |
| 4,145,075 | 3/1979 | Holzmann | 285/81 |
| 4,150,250 | 4/1979 | Lundeberg | 439/462 |
| 4,234,218 | 11/1980 | Rogers | 285/162 |
| 4,293,178 | 10/1981 | Lee | 339/103 R |
| 4,350,840 | 9/1982 | Michaels | 174/65 SS |
| 4,358,079 | 11/1982 | Navarro | 285/161 |
| 4,386,817 | 6/1983 | Benker et al. | 339/103 B |
| 4,481,697 | 11/1984 | Bachle | 24/135 R |
| 4,494,779 | 1/1985 | Neff et al. | 285/159 |

FOREIGN PATENT DOCUMENTS

| | | | |
|---|---|---|---|
| 3122388 | 12/1982 | Fed. Rep. of Germany | 174/65 SS |
| 2045883 | 11/1980 | United Kingdom | 285/331 |
| 832642 | 7/1979 | U.S.S.R. | 174/65 SS |

OTHER PUBLICATIONS

Hubbell, Kellems, sales brochures.
T & B, sales catalog & brochures.
Carlon, sales brochure, 2/1/85.
Woodhead, "Max Loc", sales brochure.
Olflex, "Skin Top", sales brochure.
0-2/Cedney, sales catalog.
Raco, catalog.

*Primary Examiner*—Neil Abrams
*Attorney, Agent, or Firm*—Jones, Day, Reavis & Pogue

[57] ABSTRACT

A four-piece all plastic strain relief connector for connecting an electrical cord to an electrical fixture comprising a body member and cap member which threadably engage to form a chamber. Located within this chamber is a collet and diaphragm assembly consisting of a flexible diaphragm snap-fit to a semi-rigid collet. The diaphragm has an aperture through which the cord passes and which forms a liquid-tight seal with the cord. The collet has a plurality of deformable tines for gripping the cord. One end of the body member is attached to a through hole in the electrical fixture. After the cord is inserted through the connector, the cap and body members are tightly screwed together such that a protrusion on the body deforms the tines on the collet into engagement with the cord. Teeth on the tines engage the plastic jacket of the cord to provide a secure grip. A sealing member formed on the collet makes a liquid-tight seal with the body member and resists the force required to insert the cord through the aperture of the diaphragm, thus the tines are prevented from being prematurely deformed by the protrusion.

11 Claims, 2 Drawing Sheets

STRAIN RELIEF CONNECTORS FOR FLEXIBLE CORD AND CABLE

BACKGROUND OF THE INVENTION

This invention relates to strain relief connectors, generally, and, more specifically, to an improved connector for securing an electrical cable or cord in a through hole of an electrical fixture, such as a junction or outlet box.

In industrial settings, electrical cords are subject to rough treatment due to the hostile environment of the workplace. It is necessary, therefore, to provide a connector which will prevent pull-out of the cord from the electrical fixture. It is also necessary to provide a liquid-tight seal to prevent liquids and other foreign matter in the environment from entering the inside of the fixture.

Generally, prior art devices use a pair of screwthreadably engaged pieces having a bore, through which the cord is inserted. Located between the cord and the two screwthreadably engaged pieces is a flexible member, such as a grommet. When the two mating pieces are tightly screwed together, the flexible grommet is radially and axially deformed into engagement with the cord. The grommet functions to seal and grip the cord to prevent pull-out of the cord from the electrical fixture.

No adequate connector has been developed which can simply but effectively form a secure liquid-tight coupling between the cord and the electrical fixture. The known connectors employ a relatively high number of parts which are cumbersome to assemble and which do not effectively grip and seal the cord. Moreover, the metal parts used in many of the known connectors require machining, thus substantially increasing the cost of manufacture.

SUMMARY OF THE INVENTION

The present invention overcomes the above noted difficulties by providing a simple, inexpensive and effective cord connector that requires no machining.

The connector assembly consists of a body member and a cap member that screwthreadably engage with one another to form a chamber. Located within this chamber is a collet and diaphragm assembly. This assembly includes a flexible diaphragm which is snap-fit to a semi-rigid collet. The diaphragm has an aperture which forms a liquid-tight seal with the cord; the collet has a plurality of deformable tines for gripping the cord.

One end of the body member is attached to an electrical fixture at a through hole therein such that a cord inserted through the connector assembly enters the electrical fixture. The cap and body members are tightly screwed together causing a protrusion on the body member to deform the tines on the collet into engagement with the cord. Teeth located on the tines engage the plastic jacket of the cord to provide a secure grip.

OBJECTS OF THE INVENTION

It is a general object of this invention to provide an improved strain relief connector to secure a cord in a through hole of an electrical fixture.

It is another object of this invention to provide a liquid-tight seal between the connector assembly and the cord, capable of accommodating cords having a wide range of sizes and shapes.

It is a further object of this invention to provide a strain relief connector which resists pull-out of the cord from the fixture.

It is still another object of this invention to design a connector of all plastic construction thereby lowering the cost of manufacture.

It is yet another object of the invention to provide a connector which is simple to use.

It is to be understood that other objects of the invention, in addition to those set forth above, will become apparent to those skilled in the art from the following detailed description and drawings.

DETAILED DESCRIPTION OF THE INVENTION

Figure 1:
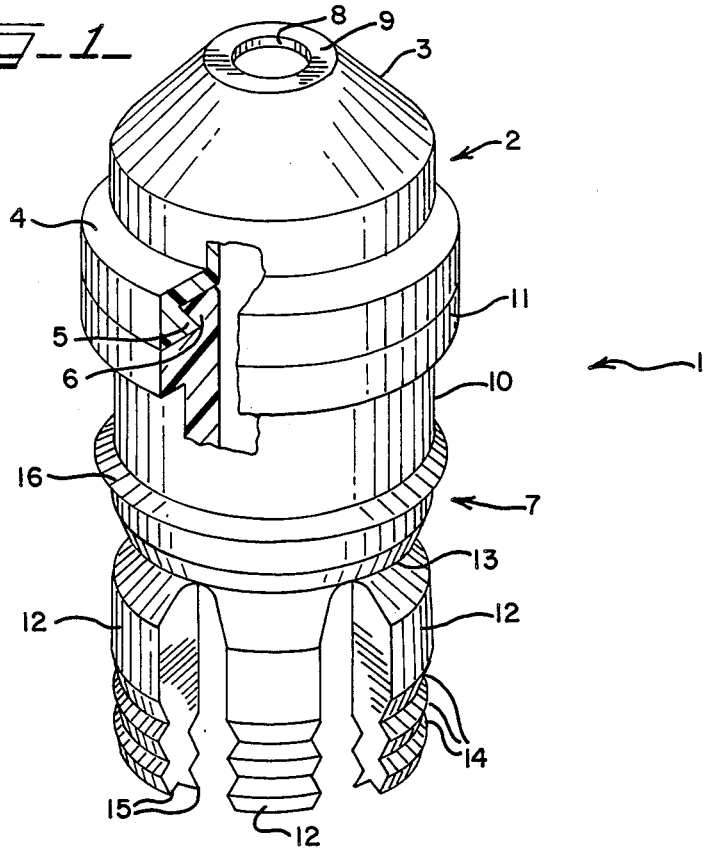
FIG. 1 is a partially cut-away isometric view of the collet and diaphragm assembly.
Figure 4:
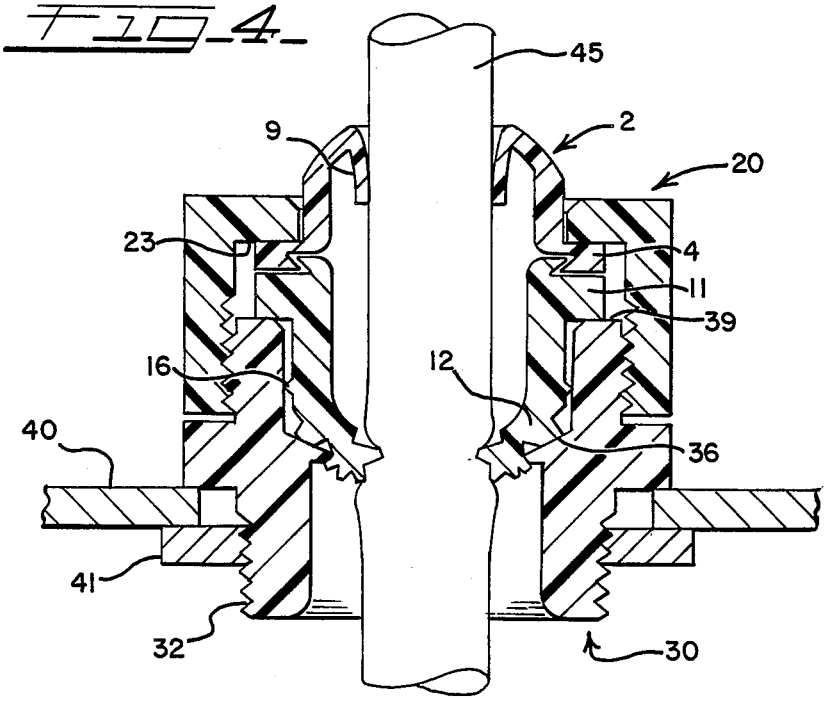
FIG. 4 is a sectional view of the connector assembly in its operative condition and associated with an electrical cord.

Referring more particularly to the drawings, FIG. 1 shows the collet and diaphragm assembly generally at 1. The diaphragm 2 is made of a very flexible plastic material. The diaphragm has a generally conical section 3 which terminates in a flange 4 having a lock rim 5. The lock rim 5 cooperates with a corresponding lock rim 6, on the collet 7, to snap-fit the diaphragm 2 to the collet 7 to form the unitary assembly 1. Located in the center of the conical section 3 is an aperture 8, having a dished rim 9, as shown in FIG. 4, which facilitates insertion of the electrical cord 45 into the diaphragm 2.

The collet 7 is made of the same plastic material as the diaphragm but has a higher modulus of elasticity and is, therefore, more rigid than the diaphragm. The collet 7 consists of a barrel portion 10 that terminates at its one end in a flange 11 having the lock rim 6. Integrally formed on the opposite end of the barrel is a plurality of tines or fingers 12. The tines 12, while relatively rigid, can bend inwardly at the respective hinge portions 13 which are formed by reduced thickness areas of the collet 7.

Located on the outer surface of each tine 12 are a plurality of lock serrations 14, the function of which will be hereinafter described. The tines 12 are also notched to form teeth 15, engageable with the plastic cover of the cord to prevent pull-out of the cord from the fixture as will be explained.

Located around the periphery of the barrel portion 10 is an integrally formed sealing ring 16. The sealing ring 16 abuts the inner surface of a body member 30, when the connector is assembled, to form a liquid-tight seal between the body 30 and collet 7. The sealing ring also acts to prevent the collet tines from collapsing under the insertion force of the cord, as will hereafter be described.

Figure 2:
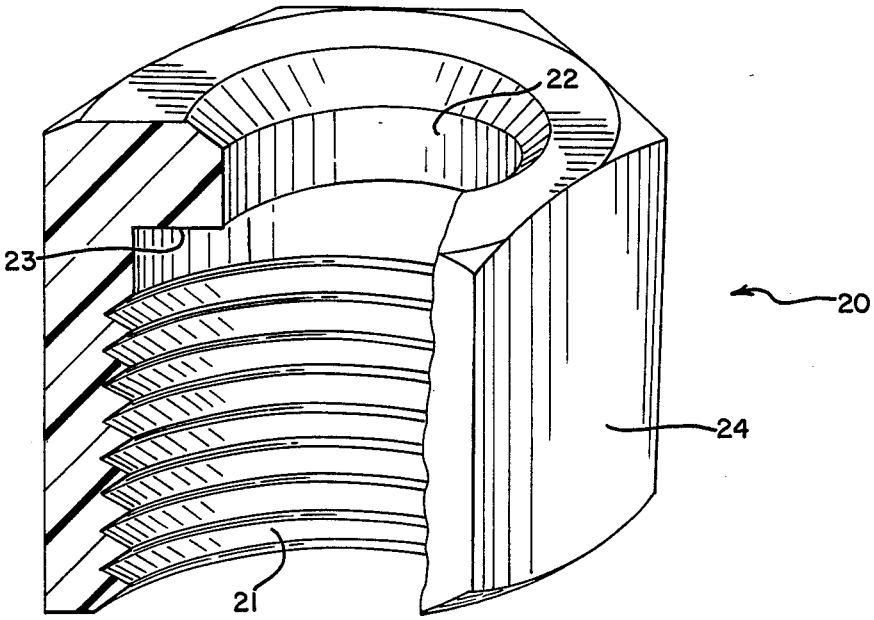
FIG. 2 is a partially cut-away isometric view of the cap member.

As shown in FIG. 2, a cap member 20 consists of a porton formed with internal screwthreads 21 and an aperture 22. The diameter of the aperture 22 is slightly smaller than the inside diameter of the threaded portion 21. As a result, a rim 23 is formed. A series of flat faces 24 extend around the perimeter of the cap member 20 and are engageable by a wrenching tool.

Figure 3:
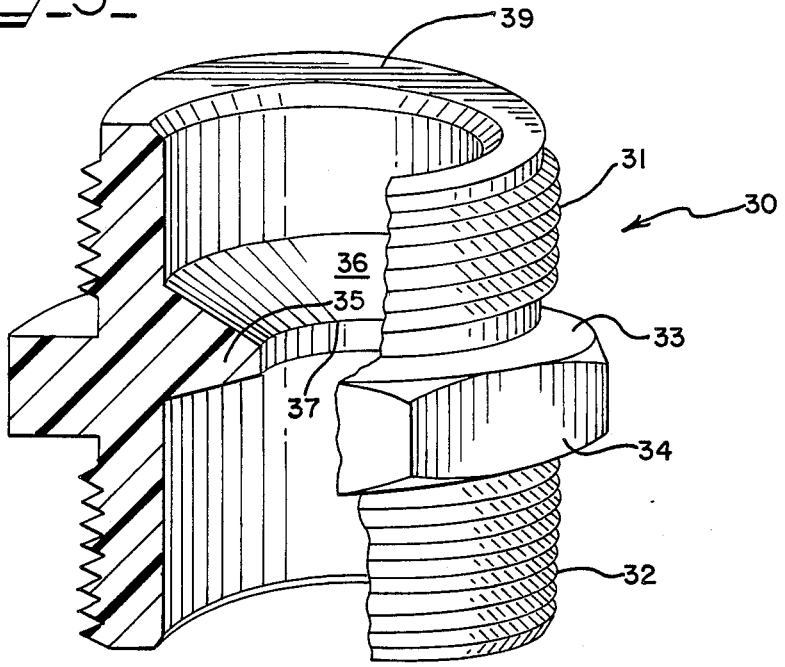
FIG. 3 is a partially cut-away isometric view of the body member.

The body member 30, shown in FIG. 3, is annular in shape with a first set of external screwthreads 31 engageable with the internal screwthreads 21 of the cap member 20 to form a chamber. The body member 30 includes a second set of external screwthreads 32 engageable with an electric fixture. Located on the outer surface of the body member 30, between the two sets of screwthreads 31 and 32, is a wrenching shoulder 33. The wrenching shoulder 33 consists of a series of flat faces 34 arranged around the periphery of the body member 30, engageable by a wrenching tool.

Formed on the inner surface of the body member 30, for its entire circumference, is a protrusion 35. The top surface of the protrusion forms a deflection ramp 36 which cams the tines 12 of the collet 7 into engagement with the electrical cord. The edge 37 of the protrusion engages the lock serrations 14 on the tines 12 to lock the deflected tines in the engaged position. The body member includes a ledge 39 which acts as a support for the collet and diaphragm assembly when the device is assembled.

FIG. 4 shows the device in its assembled condition. The connector body 30 is secured to a panel 40 of an electrical fixture, either by direct engagement of the screwthreads 32 with an aperture in the panel 40 or by engagement of the screwthreads 32 with a locknut 41, as shown in FIG. 4. It is desirable to taper the threads 32 to provide a tight fit between the body 30 and the electrical fixture. It is also desirable to use a sealing means such as a rubber gasket, between the body member and panel wall to facilitate a liquid-tight seal.

During the process of assembly, the cap member 20 is loosely screwed onto the body member 30 with the collet and diaphragm assembly located within the chamber such that the tines 12 of the collet 7 are not bent inwardly by the deflection ramp 36. The cord 45 is inserted through the collet and diaphragm assembly into the interior of the electrical fixture 40. The cord, as it is inserted through the aperture 8 in the diaphragm 2, will exert a force tending to push the collet and diaphragm assembly into the cavity of the body portion where the tines would be prematurely deformed by the deflection ramp. However, the frictional force between the sealing ring 16 and the internal surface of the body member is greater than the force required to insert the cord through the aperture 8, therefore, the cord can be inserted through the aperture without moving the collet and diaphragm assembly. The dished rim 9 of the diaphragm 2 is deformed and enlarged when the cord 45 is inserted through the aperture 8. As a result, a liquid-tight seal is formed between the diaphragm and the cord as the resilient material of the diaphragm 2, under tension from the enlargement of the aperture 8 by the cord 45, seals the cord. The flexibility of the diaphragm 2 enables it to form a seal with cords of a wide range of shapes and sizes.

Continuing with the assembly process, the cap member 20 is tightly screwed onto the body member 30. As the cap member 20 is screwed down, the rim 23 abuts the flange 4 of the diaphragm to align the diaphragm and collet assembly and to force the tines 12 into engagement with the deflection ramp 36. Because the deflection ramp 36 is angled downwardly and inwardly relative to the cord 45, the tines 12 are cammed into engagement with the cord. The teeth 15 crimp the flexible wall of the cord to form a secure grip. The lock serrations 14 are engaged by the edge 37 of the protrusion 35 to lock the tines 12 in the engaged position. The flange 11 of the collet abuts the ledge 39 of the body member to limit the engagement of cap member with the body member. The flanges 4 and 11 are, therefore, gripped between the ledge 39 and the rim 23. Accordingly, a secure, liquid-tight connection is formed between the cord and the electrical fixture as shown in FIG. 4.

Although the invention has been described with a certain degree of particularity, it is understood that the present disclosure has been made by way of example only. Numerous changes in the details and construction will be apparent without departing from the spirit and scope of the invention.

What is claimed is:

1. A strain relief connector for securing a cord to an electrical fixture comprising:

a. an annular plastic body member including: a means for securing said body member to the electrical fixture, a first set of screwthreads formed on a portion of said body member, a protrusion extending from the inner surface of said body member for the entire circumference thereof, and a deflection ramp formed on said protrusion;

b. a plastic cap member including a second set of screwthreads engageable with said first set of screwthreads of said body member to fasten said body member to said cap member and thereby to form a chamber, said cap member having a through aperture coaxially disposed with said body member when said first set of screwthreads engages said second set of screwthreads;

c. a diaphragm made of flexible plastic material including a dished portion having an aperture adapted to receive a cord, said diaphragm including a flange provided with a locking means;

d. a plastic collet having a bore adapted to receive a cord and including a plurality of tines and a second locking means for engaging said locking means of said diaphragm such that a unitary collet and diaphragm assembly is formed;

said unitary collet and diaphragm assembly arranged within said chamber, said tines being deformed by said deflection ramp as said cap member is tightly screwed into engagement with said body member such that a cord will be gripped by said tines.

2. The strain relief connector of claim 1, wherein a rim on the cap member engages said flange of said diaphragm to force said tines into engagement with said deflection ramp.

3. The strain relief connector of claim 2, wherein said collet is provided with a flange which abuts a ledge on said body member such that said flange on said diaphragm and said flange on said collet are gripped between said ledge and said rim.

4. The strain relief connector of claim 1, wherein said tines include teeth formed on the extremities thereof.

5. The strain relief connector of claim 1, wherein lock serrations formed on said tines cooperate with an edge of said protrusion to maintain the tines in the deformed condition.

6. The strain relief connector of claim 1, wherein said tines are deformed at a hinge portion.

7. The strain relief connector of claim 1, wherein said means for securing includes external screwthreads engageable with a locknut.

8. The strain relief connector of claim 1, wherein said dished portion of the diaphragm is deformable and expandable such that the flexible plastic material of the dished portion is under tension to form a liquid-tight seal with a cord.

9. The strain relief connector of claim 1, wherein said body member is provided with a wrenching shoulder engageable with a wrenching tool.

10. The strain relief connector of claim 1, wherein a sealing means integrally formed on said collet abuts the inner surface of said body member to form a liquidtight seal.

11. The strain relief connector of claim 10, wherein the frictional force between said sealing means and the inner surface of said body member is greater than the force required to insert a cord through said aperture.

* * * * *